US007061442B1

(12) United States Patent
Tang et al.

(10) Patent No.: US 7,061,442 B1
(45) Date of Patent: Jun. 13, 2006

(54) ULTRA-WIDEBAND ANTENNA

(75) Inventors: Chia-Lun Tang, Miao-Li Hsien (TW); Kin-Lu Wong, Kao-Hsiung (TW); Saou-Wen Su, Taipei (TW); Yuan-Chih Lin, Yun-Lin Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/140,060

(22) Filed: May 28, 2005

(30) Foreign Application Priority Data

Feb. 5, 2005 (TW) ..... 94103911 A

(51) Int. Cl.
*H01Q 13/10* (2006.01)

(52) U.S. Cl. ..... 343/767; 343/770

(58) Field of Classification Search ..... 343/767, 343/770

See application file for complete search history.

(56) References Cited

U.S. PATENT DOCUMENTS

| | | | | |
|---|---|---|---|---|
| 5,025,264 | A * | 6/1991 | Stafford | 343/767 |
| 5,061,943 | A * | 10/1991 | Rammos | 343/770 |
| 6,606,071 | B1 * | 8/2003 | Cheng et al. | 343/767 |
| 6,774,859 | B1 | 8/2004 | Schantz et al. | 343/742 |
| 2005/0168389 | A1 * | 8/2005 | Yuanzhu et al. | 343/767 |
| 2006/0055612 | A1 * | 3/2006 | Kim et al. | 343/767 |

OTHER PUBLICATIONS

CPW-fed planar ultra wideband antenna having a frequency band notch function/Electronics Letters/vol. 40, Issue 7, pp. 403-405, 2004.

Frequency notched UWB antennas/ Ultra Wideband Systems and Technologies, IEEE, pp. 214-218, 2003.

A parametric study of band-notched uwb planar monopole antennas / Antennas and Propagation Society Symposium, IEEE vol. 2, pp. 1768-1771 vol. 2,2004.

Planar ultra wide band slot antenna with frequency band notch function / Antennas and Propagation Society Symposium, IEEE vol. 2, pp. 1788-1791 vol. 2,2004.

* cited by examiner

*Primary Examiner*—Tho Phan

(57) ABSTRACT

An ultra-wideband (UWB) antenna is provided. It comprises a dielectric substrate, a ground plate, a metal plate, and a transmission line. The ground plate formed on the dielectric substrate has a first slot thereon. The metal plate formed on the dielectric substrate has a feed-point and a second slot thereon. The total length of the second slot is about a half-wavelength at the desired notched frequency for the UWB antenna. By embedding the second slot of a suitable length on the metal plate resided in the first slot, a band notched characteristic is achieved for the antenna in the 5 GHz band, thereby overcoming the problem of signal interference with the UWB operations. The disclosed antenna and the circuitry for the antenna system are easily integrated. With the simple structure, the fabrication cost for the antenna is also reduced.

11 Claims, 12 Drawing Sheets

ULTRA-WIDEBAND ANTENNA

FIELD OF THE INVENTION

The present invention generally relates to antennas, and more particularly to a band-notched ultra-wideband (UWB) antenna.

BACKGROUND OF THE INVENTION

In recent years, transmission speed and information capacity of wireless communications are increased in an exponential rate, driven by the increasing demand for short-range wireless communications, wireless local area networks (WLANs), and personal mobile communications devices. For these related applications, Federal Communications Commissions (FCC) specified in February 2002 that ultra-wideband communications technologies are to be used for commercial communications and for high-speed, low-power and short-range communications. In addition, Institute of Electrical and Electronic Engineering (IEEE) also proposed a new standard, IEEE 802.15 WPAN (wireless personal area network), for mobile communications consumer devices to provide high-speed and low-power ultra-wideband communications. However, over the designated UWB frequency band, there are existing WLAN operating bands such as the 5.2 GHz (5150–5350 MHz) and 5.8 GHz (5725–5825 MHz) bands, which may cause interference with the UWB operations. To prevent the interference from the WLAN system, the ultra-wideband communications system conventionally requires that the employed ultra-wideband antenna be connected to an external band-stop filter to block the WLAN signals. This approach, however, increases the production cost and the design complexity of the system circuitry.

Schantz et al. disclosed ultra-wideband monopole and dipole antennas in U.S. Pat. No. 6,774,859 issued in 2002. The technique incorporates one or more slits and one or more curved narrow slots on a metal plate of the antenna. An antenna as such exhibits multiple operation bands or a destructive band to cast out the frequency range overlapping with other communications systems. The major disadvantage of the prior art lies in that the antenna requires a very large metal plate and is too difficult to be integrated with the ground plate of the antenna's RF circuitry.

Accordingly, an ultra-wideband planar antenna is provided herein so as to achieve ultra-wideband operation, suppress interference, and be integrated with the antenna system's ground plate.

SUMMARY OF THE INVENTION

The present invention has been made to overcome the aforementioned drawback of the conventional ultra-wideband antennas. The primary objective of the present invention is to provide an ultra-wideband antenna that has a band-notched function for suppressing interference. The antenna is also easier to be integrated with the antenna system's ground plate.

Accordingly, the present invention mainly comprises a dielectric substrate, a ground plate, a metal plate, and a transmission line. The dielectric substrate has a first surface and a second surface. The ground plate has a first slot formed on top of the dielectric substrate. The metal plate has a feeding point and a second slot formed on top of the dielectric substrate. The total length of the second slot is about a half-wavelength at the center frequency of the antenna's notched frequency band. The transmission line has a signal wire and a transmission line ground unit, which are connected to the feeding point and the ground plate, respectively.

The major characteristic of the present invention is the configuration of the second slot on the metal plate. The second slot is a curved narrow slot having a U or inverted-U shape positioned symmetrically with respect to the central axis of the metal plate. Around the center frequency of the antenna's notched frequency band, strong out-of-phase currents surround the outer and inner perimeters of the second slot, causing a destructive interference with the initial current distributions in the metal plate having no second slot. The antenna therefore becomes non-responsive and its radiation efficiency is severely attenuated in the notched frequency band.

The ultra-wideband antenna may be excited by a co-planar waveguide feed-line, a microstrip feed-line, or a coaxial feed-line. During the manufacturing process, the formation of the antenna may be integrated with the laminated ceramic co-fire process of the printed circuit board.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1A:
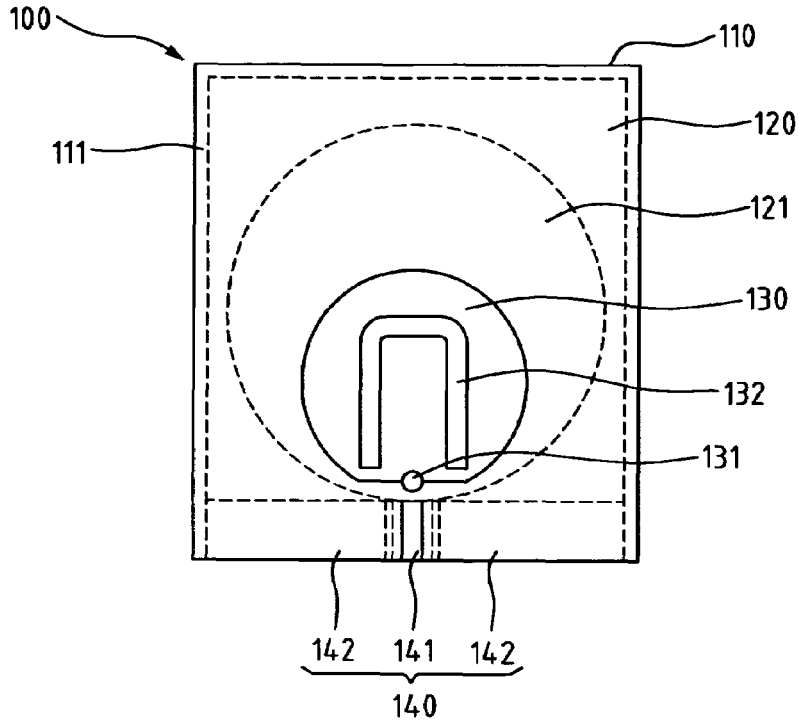
FIG. 1*a* is a schematic top view of an ultra-wideband antenna according to the present invention.
Figure 1B:
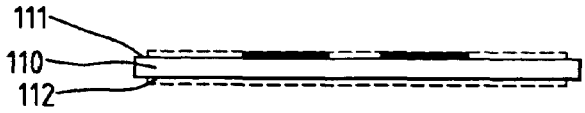
FIG. 1*b* is a schematic side view of the ultra-wideband antenna of FIG. 1*a*.

FIG. 1*a* is a schematic top view of an ultra-wideband antenna according to the present invention. FIG. 1*b* is a schematic side view of the ultra-wideband antenna of FIG. 1*a* As illustrated, the ultra-wideband antenna 100 comprises a dielectric substrate 110, a ground plate 120, a metal plate 130, and a transmission line 140. The dielectric substrate 110 has a first surface 111 and a second surface 112. The ground plate 120 has a first slot 121 formed on the first surface 111 of the dielectric substrate 110. The metal plate 130 has a feed-point 131 and a second slot 132, formed also on the first surface 111 of the dielectric substrate 110. The total length of the second slot 132 is about a half-wavelength at the center frequency of the antenna 100's notched frequency band. The transmission line 140 comprises a signal wire 141 and a feed-line ground unit 142, which are connected to the feed-point 131 and the ground plate 120 respectively. The feed-line 140 may be implemented as a co-planar waveguide feed-line, a microstrip feed-line, or a coaxial feed-line, as described in the following embodiments respectively.

Figure 2A:
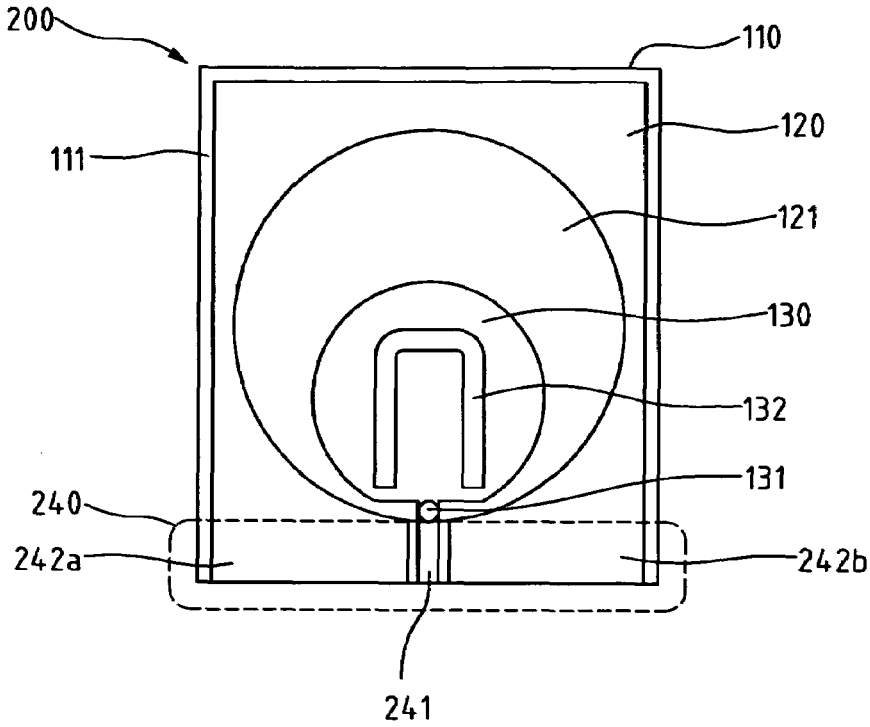
FIG. 2*a* is a schematic top view of an ultra-wideband antenna according to a first embodiment of the present invention.
Figure 2B:
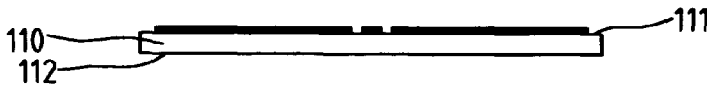
FIG. 2*b* is a schematic side view of the ultra-wideband antenna of FIG. 2*a*.

FIG. 2*a* is a schematic top view of an ultra-wideband antenna according to a first embodiment of the present invention. FIG. 2*b* is a schematic side view of the ultra-wideband antenna of FIG. 2*a*.

As illustrated, the first embodiment adopts a co-planar waveguide feed-line 240 whose signal wire is a central metal wire 241 and whose grounding unit includes a first feed-line ground plate 242*a* and a second feed-line ground plate 242*b*. The ultra-wideband antenna 200 according to the present embodiment comprises a dielectric substrate 110, a ground plate 120, a metal plate 130, and the co-planar waveguide feed-line 240. The dielectric substrate 110 has a first surface 111 and a second surface 112. Both the ground plate 120 and the metal plate 130 are formed on the first surface 111 of the dielectric substrate 110. The ground plate 120 has a first slot 121. The metal plate 130 is located inside the first slot 121, and has a feed-point 131 and a second slot 132. The co-planar waveguide feed-line 240 is also formed on the first surface 111 of the dielectric substrate 110. The central metal wire 241 is connected to the feed-point 131. The first and second feed-line ground plates 242*a* and 242*b* are located at the two sides of the central metal wire 241, separated by the central metal wire 241. Both the first and second feed-line ground plates 242*a* and 242*b* have a matching width as the central metal wire 241, and are connected to the ground plate 120 respectively.

The ultra-wideband antenna 200 according to the present embodiment is a planar print-typed wide slot antenna using a co-planar waveguide feed-line 240. The advantage of the antenna 200 is that it may be easily integrated with and could be printed on the same dielectric substrate as the antenna 200's RF circuitry. In addition, by embedding a second slot having an appropriate length on the metal plate inside the first slot, the ultra-wideband antenna may solve the signal interference problem by having a notched frequency band around the 5 GHz band for wireless LAN within the antenna's operation bandwidth.

Figure 3:
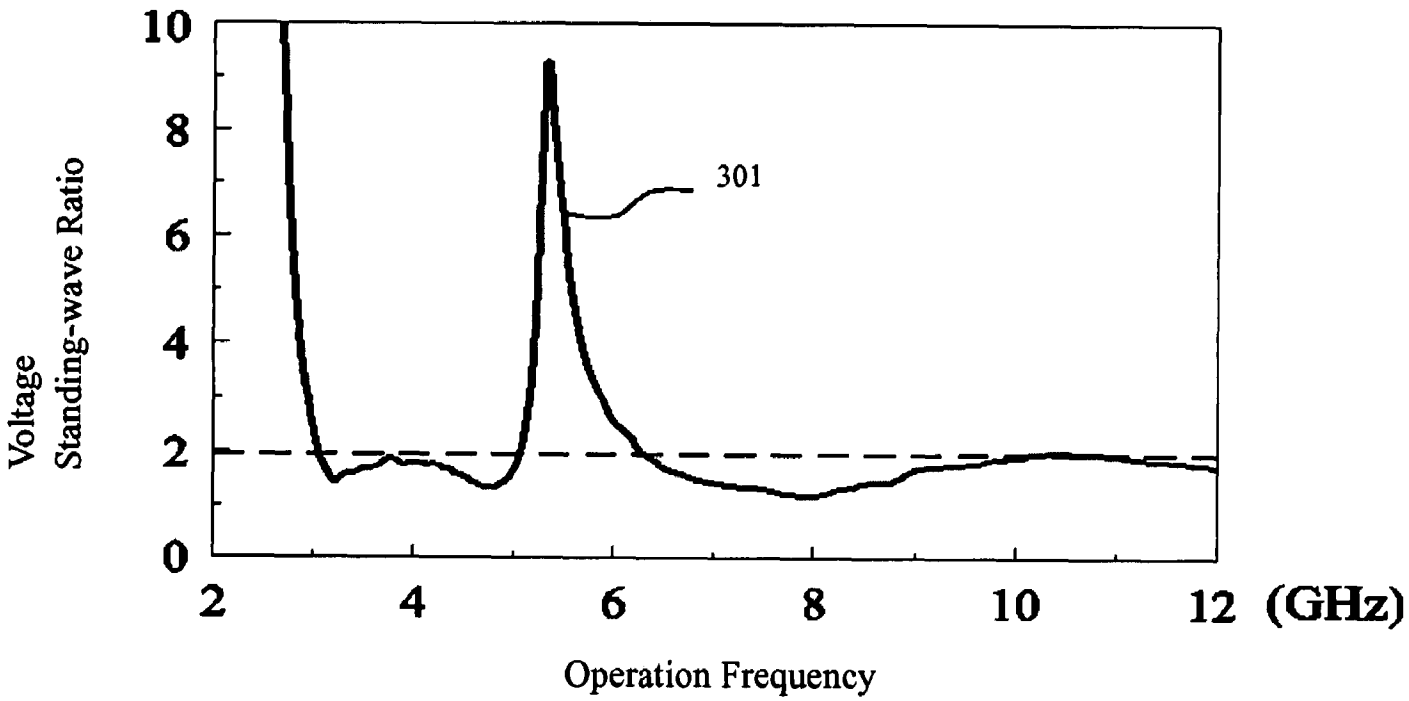
FIG. 3 shows the experimental results for the voltage standing-wave ratio (VSWR) of an antenna according to the first embodiment of the present invention.

FIG. 3 shows the experimental results for the voltage standing-wave ratio (VSWR) of an antenna according to the first embodiment of the present invention. The experiment is performed based on the following parameters. The dielectric substrate 110 is made of fiberglass reinforced epoxy resin having a thickness 0.4 mm and a dielectric constant 4.4. The ground plate 120 has a length about 30 mm and a width about 25 mm. The diameter of the metal plate 130 is about 14 mm. The second slot 132, having an inverted U shape, is of about 25 mm in length, which is about a half-wavelength at 5.5 GHz. As illustrated in FIG. 3, the vertical axis shows the voltage standing-wave ratio and the horizontal axis shows the operation frequency. Based on the measurements shown in FIG. 3, the antenna has an ultra-wide frequency band from 3.1 GHz to 10.6 GHz, all satisfying a 2:1 voltage standing-wave ratio and, within this frequency band, there is a notched frequency band 301, which covers the 5 GHz (5.150–5.825 GHz) band for the wireless LAN.

Figure 4:
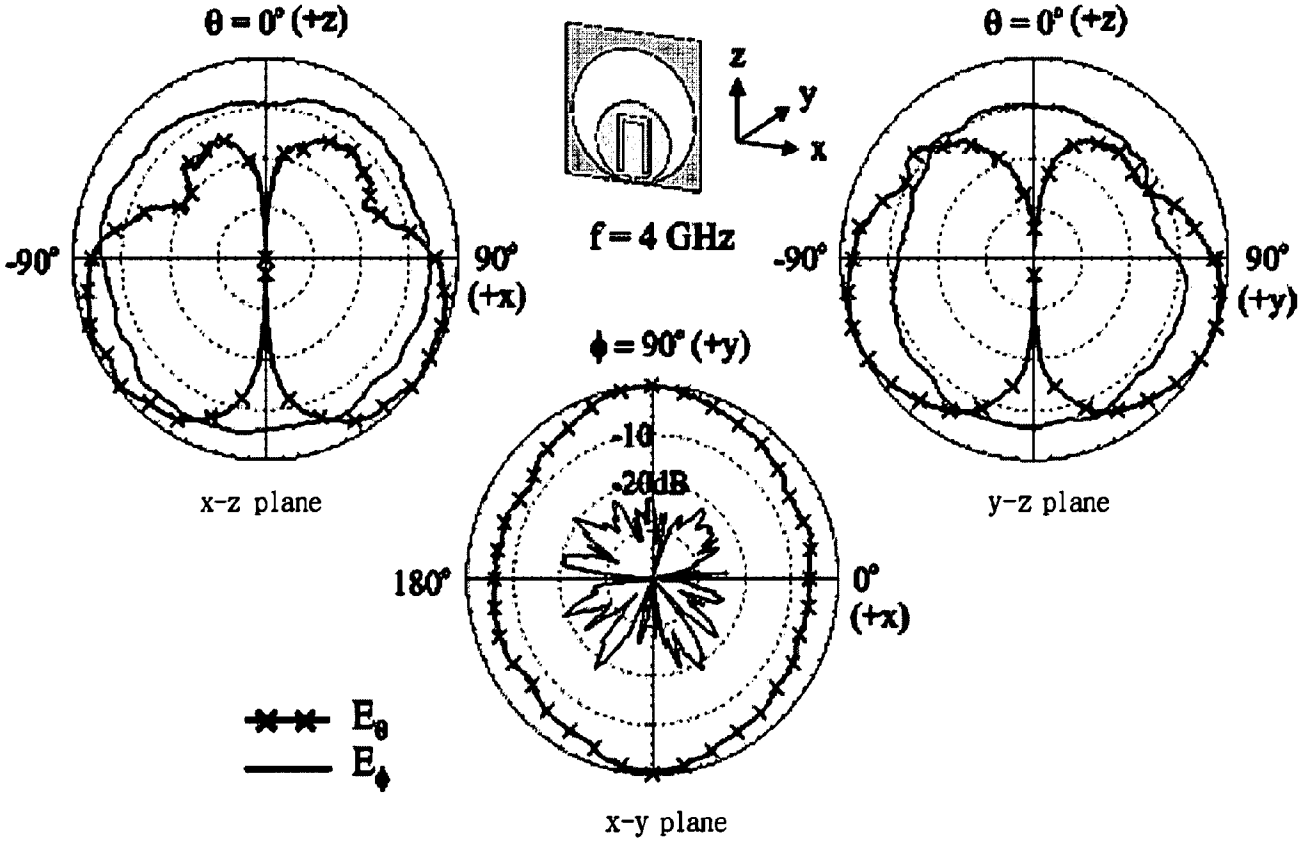
FIG. 4 shows the experimental results for the radiation patterns of an antenna according to the first embodiment of the present invention at 4 GHz.
Figure 5:
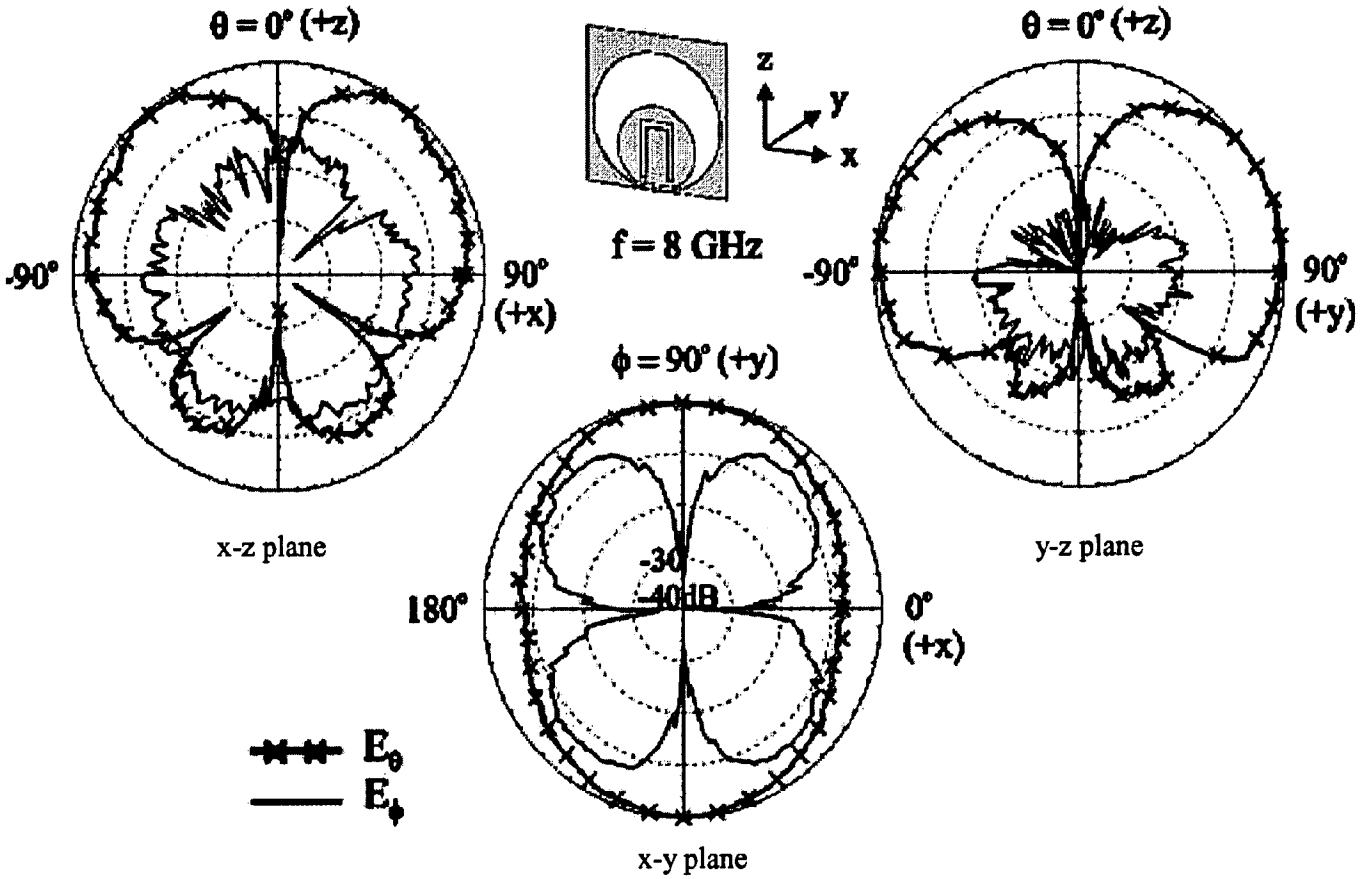
FIG. 5 shows the experimental results for the radiation patterns of an antenna according to the first embodiment of the present invention at 8 GHz.

FIGS. 4 and 5 show experimental results for the radiation patterns of an antenna according to the first embodiment of the present invention at 4 GHz and 8 GHz, respectively. As illustrated, the antenna has a bi-directional pattern or a quasi-omnidirectional pattern on the horizontal plane (i.e., x-y plane), both at 4 and 8 GHz.

Figure 6:
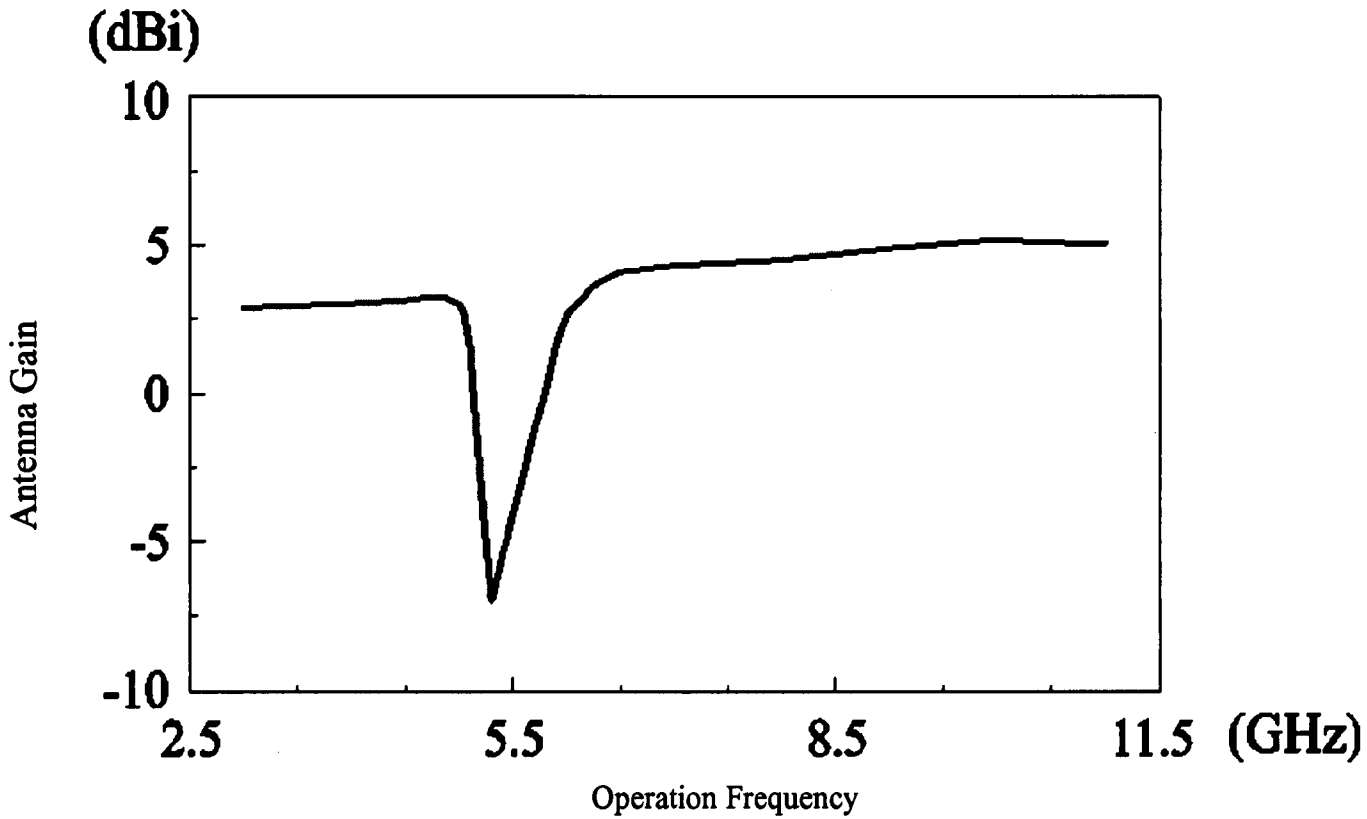
FIG. 6 shows the experimental results for the gain of an antenna according to the first embodiment of the present invention within the antenna's operation frequency band.

FIG. 6 shows experimental results for the gain of an antenna according to the first embodiment of the present invention within the antenna's operation frequency band. As illustrated, the vertical axis shows the antenna gain and the horizontal axis shows the operation frequency. Based on the measurements shown in FIG. 6, the antenna has a gain about 3.0–5.7 dBi, which satisfies the requirement of ultra-wide-band communications, and a notched frequency band having a center frequency at about 5.5 GHz and a minimum gain −6.5 dBi within this notched frequency band.

Figure 7A:
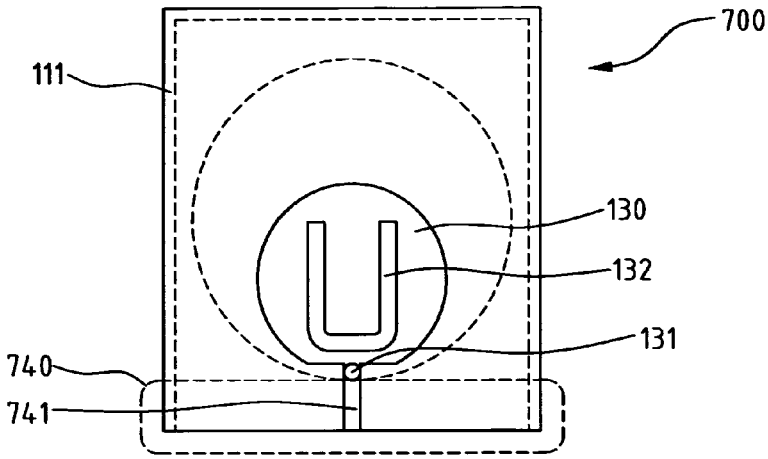
FIG. 7*a* is a schematic top view of an ultra-wideband antenna according to a second embodiment of the present invention.
Figure 7B:
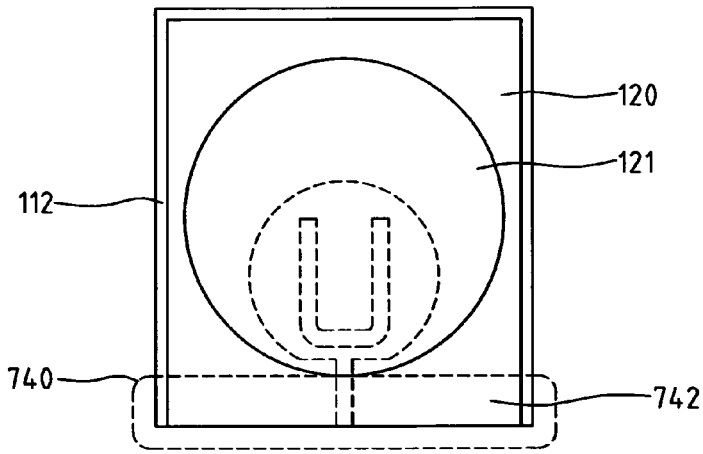
FIG. 7*b* is a schematic bottom view of the ultra-wideband antenna of FIG. 7*a*.
Figure 7C:
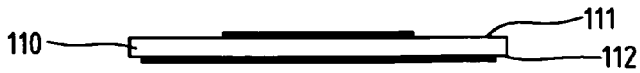
FIG. 7*c* is a schematic side view of the ultra-wideband antenna of FIG. 7*a*.

FIG. 7*a* is a schematic top view of an ultra-wideband antenna according to a second embodiment of the present invention. FIG. 7*b* is a schematic bottom view of the ultra-wideband antenna of FIG. 7*a*. FIG. 7*c* is a schematic side view of the ultra-wideband antenna of FIG. 7*a*.

As illustrated, the second embodiment adopts a microstrip feed-line 740 whose signal wire is a metal wire 741 and whose grounding unit is a feed-line ground plate 742. The ultra-wideband antenna 700 according to the present embodiment comprises a dielectric substrate 110, a ground plate 120, a metal plate 130, and the microstrip feed-line 740. The dielectric substrate 110 has a first surface 111 and a second surface 112. The ground plate 120 having a first slot 121 is formed on the second surface 112 of the dielectric substrate 110. The metal plate 130 is formed on the first surface 111 of the dielectric substrate 110 and, within a region corresponding the inside of the fist slot 121, has a feed-point 131 and a U-shaped second slot 132. The metal wire 741 is on the first surface 111 of the dielectric substrate 110 and connected to the feed-point 131. The feed-line ground plate 742 is located on the second surface of 112 of the dielectric substrate 110, within a region correspond to the outside of the first slot 121, has a matching width as the metal wire 741's length, and is electrically connected to the ground plate 120. In the mean time, a portion of the feed-line ground plate 742 is overlapped with the metal wire 741. The U-shaped second slot 132, fed by the microstrip feed-line 740, has a total length about a half-wavelength at the center frequency of the antenna 700's notched frequency band. The rest of the structure of the present embodiment is identical to the first embodiment, and both can provide ultra-wide-band operations with a notched frequency band.

Figure 8A:
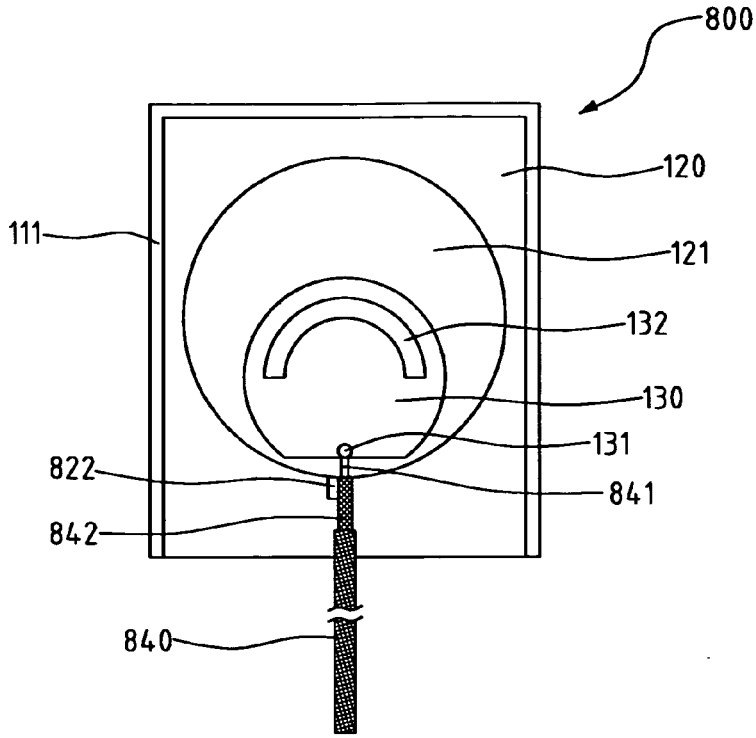
FIG. 8*a* is a schematic top view of an ultra-wideband antenna according to a third embodiment of the present invention.
Figure 8B:
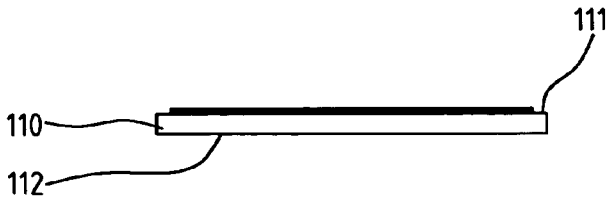
FIG. 8*b* is a schematic side view of the ultra-wideband antenna of FIG. 8*a*.
Figure 9A:
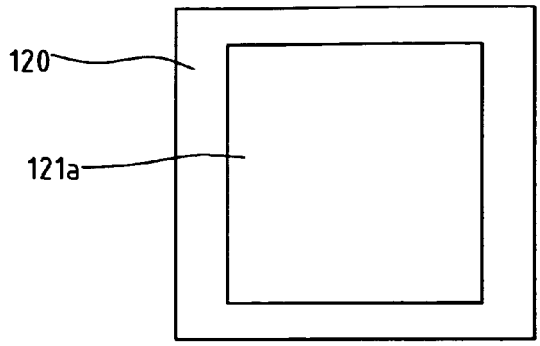
FIGS. 9*a*–9*e* show various shapes adopted by a first slot respectively.
Figure 9B:
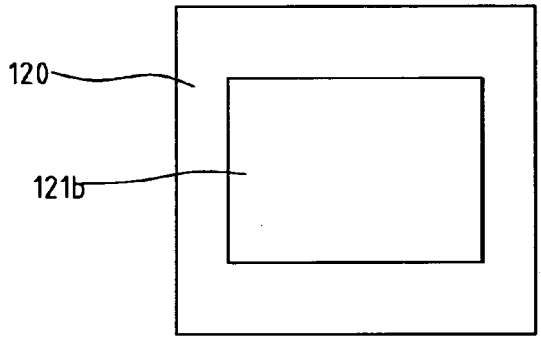
Figure 9C:
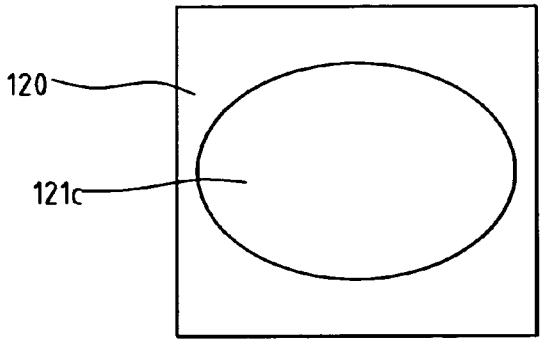
Figure 9D:
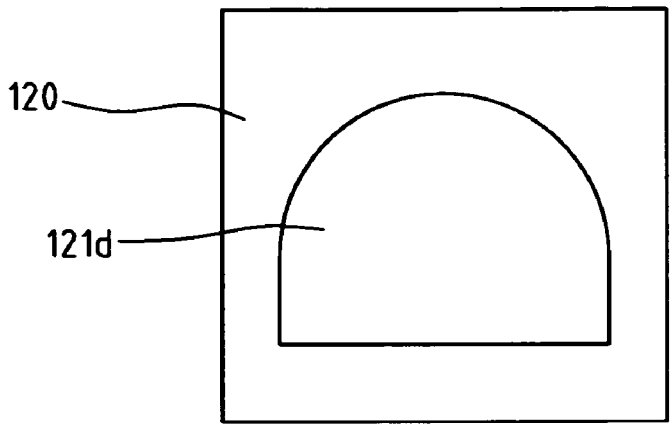
Figure 9E:
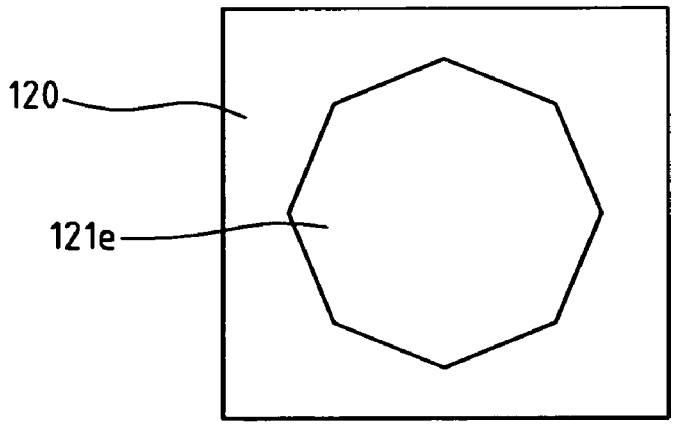
Figure 10A:
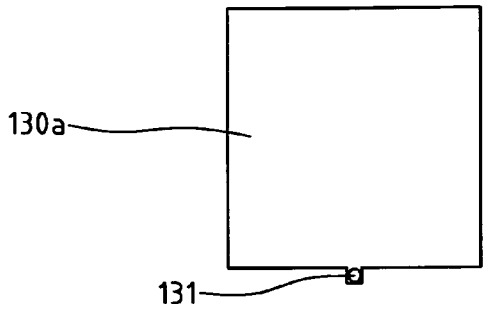
FIGS. 10*a*–10*e* shows various shapes adopted by a metal plate respectively.
Figure 10B:
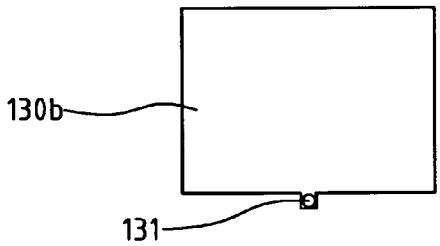
Figure 10C:
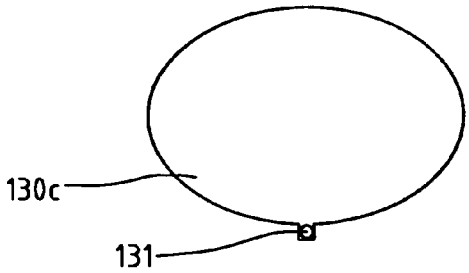
Figure 10D:
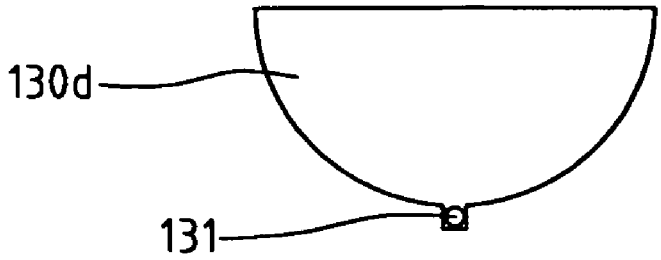
Figure 10E:
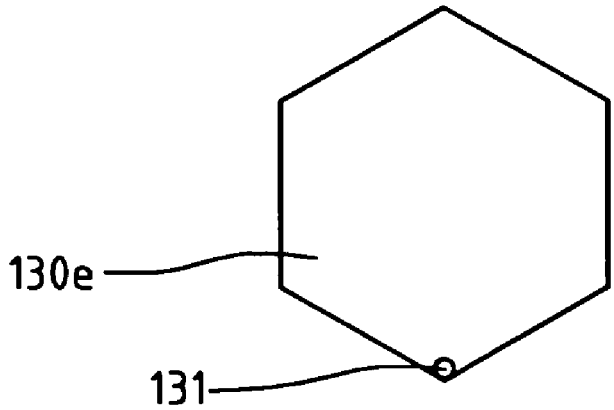

FIG. 8*a* is a schematic top view of an ultra-wideband antenna according to a third embodiment of the present invention. FIG. 8*b* is a schematic side view of the ultra-wideband antenna of FIG. 8*a*.

As illustrated, the third embodiment adopts a coaxial feed-line 840 whose signal wire is a central wire 841 and whose grounding unit is an external ground element 742. The ultra-wideband antenna 800 according to the present embodiment comprises a dielectric substrate 110, a ground plate 120, a metal plate 130, and the coaxial feed-line 840. The present embodiment shares a similar structure with that of the first embodiment except that, besides the difference of the feed-line, the ground plate 120 of the present embodiment further has a ground-point 822. The central wire 841 is connected to the feed-point 131. The external ground element 842 is connected to ground-point 822 of the ground plate 120. In the present embodiment, the second slot 132, fed by the coaxial feed-line 840, is a curved one (i.e., an arc shape) and has a total length about a half-wavelength at the center frequency of the antenna 800's notched frequency band. The rest of the structure of the present embodiment is identical to the first embodiment, and both can provide ultra-wideband operations with a notched frequency band.

FIGS. 9*a*–9*e* show various shapes adopted by a first slot respectively. As illustrated, the shape of the first slot 121 may be a square 121*a* (as in FIG. 9*a*), a rectangle 121*b* (as in FIG. 9*b*), an ellipse 121*c* (as in FIG. 9*c*), a near semi-circle 121*d* (as in FIG. 9*d*), or a polygon 121*e* (as in FIG. 9*e*).

FIGS. 10*a*–10*e* show various shapes adopted by a metal plate respectively. As illustrated, the shape of the metal plate 130 may be a square 130*a* (as in FIG. 10*a*), a rectangle 130*b* (as in FIG. 10*b*), an ellipse 130*c* (as in FIG. 10*c*), a semi-circle 130*d* (as in FIG. 10*d*), or a polygon 130*e* (as in FIG. 10*e*).

An ultra-wideband antenna according to the present invention may be fed by a co-planar waveguide feed-line, a microstrip feed-line, or a coaxial feed-line. In terms of the manufacturing process, the present invention may also be integrated, based on different requirements, with the antenna's RF circuitry in a laminated ceramic co-fire process. All these have contributed to the present invention's utility and integration capability.

According to the present invention, by adjusting the diameter of the ground plate 120's first slot 121, several resonant modes within a large frequency range can be achieved, especially in terms of the control and determination of the higher operation frequency $f_H$. On the other hand, by adjusting the diameter of the metal plate 130, which is about 0.14 $\lambda_L$, the lower operation frequency $f_L$ can be controlled and determined, as well as the magnetic flux distribution inside the first slot 121. Therefore, a better impedance matching can be achieved with an ultra-wide operation frequency band (the frequency ratio is greater than 1:3). Then the U-shaped or inverted U-shaped second slot 132 is embedded on the metal plate 130, which is substantially symmetrical with respect to the central axis of the metal plate 130 including the feed-point 131, and which has a total length about a half-wavelength at the center frequency of the notched frequency band (i.e., a half-wavelength at 5.5 GHz within the 5 GHz WLAN band). Around the center frequency of notched frequency band, the stronger currents on the surface of the metal plate 130 are clustered substantially at the inner and outer perimeters of the second slot, forming strong out-of-phase currents on the two sides of the second slot, causing a destructive interference to the initial current distribution in the metal plate with no second slot. The antenna therefore becomes non-responsive and its radiation efficiency is severely attenuated in the notched frequency band.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An ultra-wideband antenna comprising:

a dielectric substrate having a first surface and a second surface;

a ground plate having a first slot formed on top of said dielectric substrate;

a metal plate having a feed-point and a second slot formed on top of said dielectric substrate, said second slot having a total length about a half-wavelength at the center frequency of a notched frequency band of said antenna; and a transmission line including a signal wire and a feed-line ground unit connected to said feed-point and said ground plate respectively.

2. The ultra-wideband antenna according to claim 1, wherein said ground plate and said metal plate are located on said first surface, and said metal plate is located inside said first slot.

3. The ultra-wideband antenna according to claim 2, wherein said transmission line is located on said first surface, said feed-line ground unit includes a first feed-line ground unit and a second feed-line ground unit located at the two sides of said signal wire both of which have a matching width as said signal wire's length and are connected to said ground plate of said antenna.

4. The ultra-wideband antenna according to claim 3, wherein said transmission line is a co-planar waveguide feed-line.

5. The ultra-wideband antenna according to claim 2, wherein said ground plate further includes a ground point, said feed-line ground unit is formed outside of said signal wire and connected to said ground point, and said signal wire is connected to said feed-point.

6. The ultra-wideband antenna according to claim 5, wherein said transmission line is a coaxial feed-line.

7. The ultra-wideband antenna according to claim 1, wherein said ground plate is located on said second surface, said metal plate is located on said first surface within a region corresponding to the inside of said first slot, said signal wire is located on first surface, said feed-line ground unit is located on said second surface within a region corresponding to the outside of said first slot, said feed-line ground unit has a matching width as said signal wire's length, and is electrically connected to said ground plate, a portion of said feed-line ground unit is overlapped with said signal wire.

8. The ultra-wideband antenna according to claim 7, wherein said transmission line is a microstrip feed-line.

9. The ultra-wideband antenna according to claim 1, wherein the shape of said second slot includes U shape, inverted-U shape, and arc shape.

10. The ultra-wideband antenna according to claim 1, wherein the shape of said first slot includes square, rectangle, ellipse, semi-circle, and polygon.

11. The ultra-wideband antenna according to claim 1, wherein the shape of said metal includes square, rectangle, ellipse, semi-circle, and polygon.

* * * * *